US006902779B1

(12) United States Patent
de Visser et al.

(10) Patent No.: US 6,902,779 B1
(45) Date of Patent: Jun. 7, 2005

(54) TRANSFER PAPER FOR INK-JET PRINTING

(75) Inventors: Anthonie Cornelis de Visser, Scherpenzeel (NL); Cornelis Hendricus Cornelissen, Brummen (NL); Koert Johannes Sportel, Brummen (NL)

(73) Assignee: W. A. Sanders Papierfabriek Coldenhove B.V., Eerbeek (NL)

( * ) Notice: Subject to any disclaimer, the term of this patent is extended or adjusted under 35 U.S.C. 154(b) by 0 days.

(21) Appl. No.: 09/744,637

(22) PCT Filed: Jul. 28, 1999

(86) PCT No.: PCT/NL99/00485

§ 371 (c)(1),
(2), (4) Date: Mar. 21, 2001

(87) PCT Pub. No.: WO00/06392

PCT Pub. Date: Feb. 10, 2000

(30) Foreign Application Priority Data

Jul. 29, 1998 (NL) ..... 1009766

(51) Int. Cl.[7] ..... B41M 5/40

(52) U.S. Cl. ..... 428/32.12; 428/32.27; 428/32.28; 428/32.32; 428/32.34

(58) Field of Search ..... 428/32.12, 32.27, 428/32.28, 32.32, 32.34, 195, 211, 323, 537 S

(56) References Cited

U.S. PATENT DOCUMENTS

| | | | | |
|---|---|---|---|---|
| 5,672,413 A | * | 9/1997 | Taylor et al. | 428/32.12 |
| 5,897,961 A | * | 4/1999 | Malhotra et al. | 428/537.5 |
| 6,383,611 B1 | * | 5/2002 | Kohno et al. | 428/195 |

FOREIGN PATENT DOCUMENTS

| | | |
|---|---|---|
| DE | 3504813 | 8/1986 |
| EP | 0 412 084 | 7/1993 |
| EP | 0 605 840 | 7/1994 |
| EP | 0 649 753 | 4/1995 |
| FR | 2750080 | 12/1997 |
| GB | 1 460 939 | 1/1997 |
| WO | WO 97/42040 | 11/1997 |

OTHER PUBLICATIONS

"Jetcol HTR," Coldenhove Papier Brochure, Eerbeek, Holland (Jan.–Jun. 1998).
"Jetcol HTR Special," Coldenhove Papier Brochure, Eerbeek, Holland (Jun. 1998).
"Jetcol HTR. The Paper for Digital Transfer Printing," Coldenhove Papier, Eerbeek, Holland (Jul. 1998).
"New Cotton Art—A Process Which "Prints" Money For You While Protecting the Environment," Dansk KH Ltd. Brochure, undated (allegedly dating from Jul. 14, 1998).
"Coldenhove Papier Sets Standard for Digital Transfer Printing," Introductie Jetcol HTR, Eerbeek, Holland (Nov. 24, 1997).
"Textile Transfer–Printing—A Sublime Technology," Brochure of the 4th International Meeting for the Transfer–Printing–Industry, Venezia–Lido, Italy (Oct. 23–25, 1997).
"Paper and Board—Determination of Air Permeance (Medium Range)—Part 3: Bendtsen Method," International Standard, ISO 5636–3 (Sep. 15, 1992).
Einsele et al., "Beschleungung des Farbstofftransfers Beim Thermoumdruck," Melliand Textilberichte, 7:487–494 (1987) ( English translation of abstract, Section 9, pp. 493).
Inman et al., "A Special Paper for Transfer Inks" The British Ink Maker, pp. 140–141 (1977).

* cited by examiner

*Primary Examiner*—B. Shewareged
(74) *Attorney, Agent, or Firm*—Weingarten, Schurgin, Gagnebin & Lebovici LLP

(57) ABSTRACT

Transfer paper suitable for in-jet printing, provided, at least on the side to be printed, with a release or barrier layer, the layer having a porosity of at most 100 ml/min, and a method for manufacturing a transfer paper and a method for printing transfer paper with an ink-jet printer with an aqueous dispersion of a sublimable ink.

3 Claims, 3 Drawing Sheets

TRANSFER PAPER FOR INK-JET PRINTING

Figure 1:
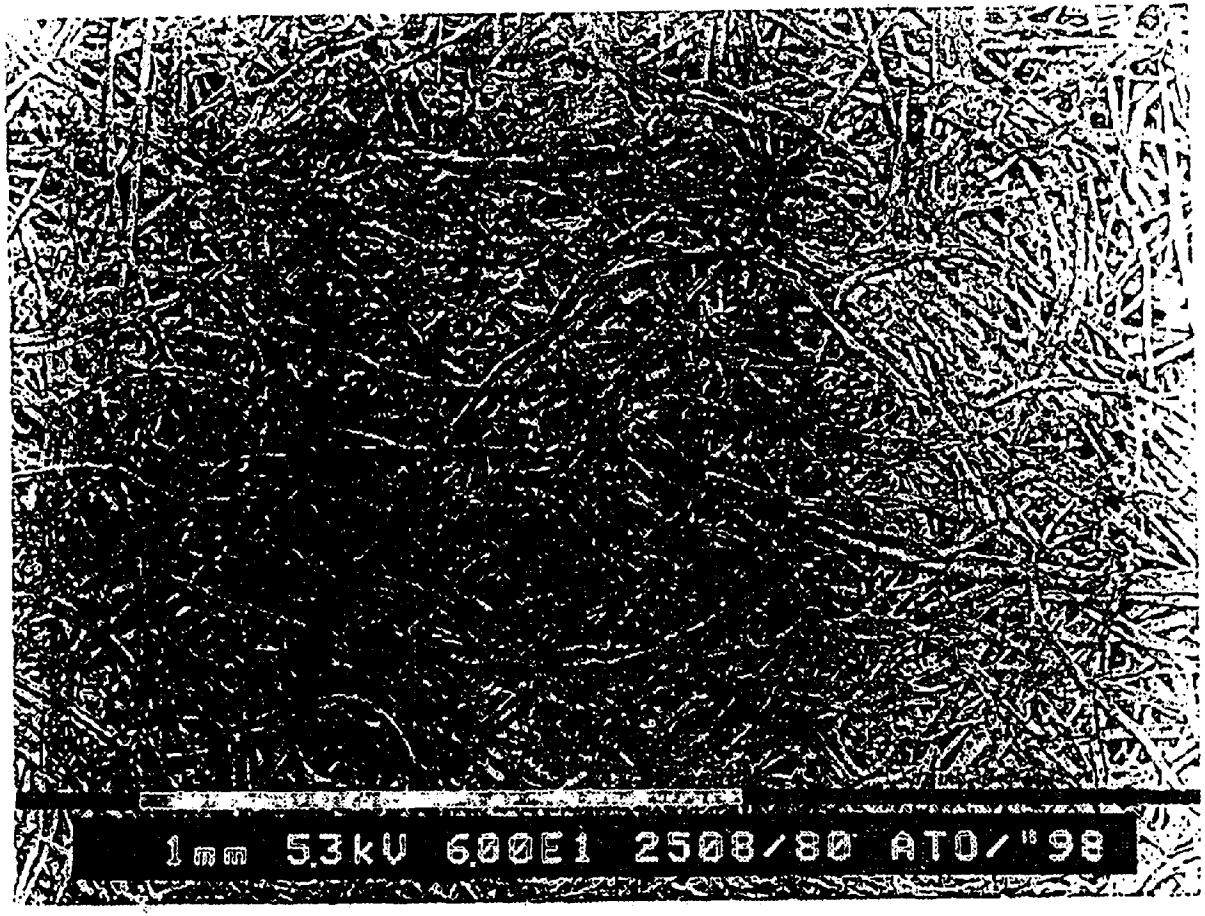

The invention relates to transfer paper.

Transfer paper is used for printing textile and material provided with a polyester coating, in particular textile of polyester, and mixtures of polyester with other fibers. To this end, by means of common printing techniques (flexographic, offset, intaglio, or rotary screen printing), a pattern, design or printing image is applied to the paper. Depending on the printing technique, the ink is thin-fluid or in the form of a pasty mass. The ink or paste contains sublimable dye components. By means of heat, the sublimable components of the ink are subsequently transferred, in the transfer process, onto the surface that is eventually to be printed. In this process, the temperatures common for transferring the dyes are within the range of from about 170° C. to about 210° C. During the transfer of the dyes in the ink, by means of heat and pressure, a portion of the dyes often stays behind on the paper. The extent to which the sublimable dye is transferred from the paper onto the textile during the transfer process is referred to as transfer efficiency.

To reduce the amount of non-transferred dye in the transfer process, measures have in the past been proposed to improve the transfer ratio (transfer efficiency). One of these measures concerned the application of a layer (release or barrier layer) to the smooth side (i.e. the side to be printed) of the paper, causing the dye to be transferred onto the substrate more easily.

In the case of a barrier layer, this layer prevents the dyes of the ink from penetrating too deep into the paper. The layer may also be applied to the paper to ensure that the material that is applied to the layer can easily be given off again or removed otherwise. In this case, such layer is referred to as release layer. In many cases, the release and barrier function can be achieved by the same material.

Through the application of a release or barrier layer to the paper, less dye remains behind on the paper after the transfer printing process, which is economically advantageous. Suitable materials for this release or barrier layer are, in particular in the case of water-based inks, hydrophilic polymers such as carboxymethylcellulose. Through the application of the layer, the extent in which the dye is transferred from the paper onto the surface to be eventually printed is increased. The effect that the application of such layer has on the transfer efficiency of the dyes is, for instance, described in an article by Dr. U. Einsele and Prof. Dr. Herlinger, Melliand Textilberichte, 7, 1987, pp. 487–494.

As a matter of fact, applying such barrier layer to the reverse side of the paper (hence not the side to be printed) is known for preventing the "ghosting effect". This effect occurs, inter alia, during the storage of the printed transfer paper. This storage is usually effected in rolls. Such paper with an anti-ghosting barrier generally has a porosity of about 200 ml/min.

The porosity is defined as the air permeability as determined according to the ISO standards. ISO standards applicable hereto are, inter alia, ISO standard 8791-2 for determining the roughness of the paper and ISO standard 5636-3 for the air permeability or porosity of the paper. This can be done with an L&W Bendtsen Tester of AB Lorentzen & Wettre, Kista, Sweden.

A drawback of the printing of paper, such as in this case transfer paper, by means of contact printing processes, and in particular a rotary screen printing process, is that a printing form has to be made, such as a screen or a template. The making of a printing form entails costs. These costs are as high for small batches (small lengths) or samplings as for great batches (great lengths). Consequently, for smaller lengths, samples and one-off designs, relatively high costs have to be made. For such utilizations, this generally renders the use of contact printing processes expensive.

Another possibility for the printing of transfer paper is the contactless printing process. In this process, a digital image is transferred onto the support material by means of an inkjet printer or another, for instance electrostatic technique. This technique has the advantage over the contact printing process that no templates, screens or other printing forms have to be used. When computer control (for instance DTP techniques) is used, it is possible to print an image directly onto the transfer paper.

Numerous publications are known relating to paper that is suitable for printing with an inkjet printer. Some of those will now be dealt with. For instance, European patent application EP-A 0 730 976 discloses a paper for an inkjet printer which is suitable for being printed with an ink based on a water-soluble dye which substantially contains carboxyl groups as hydrophilic functional groups, which paper does not contain calcium carbonate, while on at least the side of the paper that is to be printed, a water-absorbing pigment and an aqueous binder are provided as main components.

DE 19628342 describes a paper for inkjet printing provided with a synthetic layer which, after printing, can melt under the influence of heat to form a layer resistant to water and light.

DE 19604693 describes a paper for inkjet printing which comprises a layer containing pigment and binding agent, the pigment substantially consisting of bentonite and the binding agent consisting of a hydrophilic binder or a mixture thereof with a hydrophobic binder.

DE 19618607 describes a paper for an inkjet printer comprising a support material and a-color-receiving layer, while on the color-receiving layer a layer is present built up from finely-porous cationic charge centers including inorganic pigments and/or fillers. The color-receiving layer may contain, inter alia, carboxymethylcellulose.

DE 19628341 describes a paper suitable for printing with an aqueous ink, in which a layer has been applied to a temporary support material, which layer consists of thermoplastic synthetic particles and a binder, while as binder, a carboxymethylcellulose can be used, inter alia.

EP 770729 describes a paper suitable for inkjet printing with water-based inks, in which dimensional instability is prevented by subjecting the paper, before the coating process, to a treatment which obviates the shrinkage caused by the coating process.

The inks for sublimation transfer printing that are used both in contact printing processes and in contactless printing processes can be water-based. Water-based inks are q inks produced with water as main liquid component, in which the dye particles are dispersed in the liquid. To such inks, thickeners may be added to enable processing the ink as a pasty mass in, for instance, a rotary screen printing process. Inks as can be employed in the above-described processes typically contain dye particles having a particle size in the region around 0.1 $\mu$m.

A drawback of the use of water-based inks in a contactless printing process, in particular inkjet printing, is that the aqueous composition of the ink causes the different color areas to run into one another, so that a reduced color contrast is obtained. Consequently, as far as acutance of the image and contrast of the color areas are concerned, the result of the printing process is often of reduced quality. Also, the uniformity of the color areas may be adversely affected. This drawback of water-based ink occurs during the printing of known types of transfer paper by means of an inkjet printer. Paper types that are specifically suitable for inkjet printing are not suitable for the use as described hereinabove, either, inter alia because of an unduly low transfer efficiency.

Thickening the ink into a pasty mass, as in the contact printing process, does not apply to inkjet printing, because the ink can then no longer be jetted. With this, the problem concerning the flowing of the ink in the case of inkjet printing cannot be solved.

Hence, a dilemma is involved.

On the one hand, in a contact printing process, the flowing of the ink and the non-uniformity of the printed image can be prevented with a pasty ink, but this entails the higher costs of producing a printing form.

On the other, the costs of making a printing form can be avoided by a contactless printing process such as inkjet printing, but in that case, a thin-fluid ink is used and the ink can flow.

Surprisingly, it has now been found that the dilemma is solved and, consequently, the above drawbacks do not present themselves if a transfer paper is used having applied thereto a release or barrier layer of such thickness and density, and which is moreover of such composition, that the paper with the layer applied thereto has a low air permeability and/or porosity. As the porosity of the base paper (paper without the layer applied thereto) is generally many times greater (approx. 2000 to approx. 3000 ml/min) than that of the layer applied, the air permeability is determined by the layer applied thereto.

Hence, the invention relates to a transfer paper suitable for inkjet printing, which at least on the side to be printed is provided with a release or barrier layer, the layer having a porosity of at most 100 ml/min. The porosity is measured according to ISO standard 5636-3.

The use of the paper according to the invention involves no or very little flowing of the separate colors, and at the same time, during transfer of the dye onto a surface, a high transfer efficiency is obtained.

The invention also comprises a method for manufacturing transfer paper for inkjet printing wherein a release or barrier layer is applied to the side to be printed by means of a coating process in which an excess of the barrier material is applied first and subsequently wiped with a wiping knife (blade knife) or roller knife, the layer obtaining a porosity of at most 100 ml/min.

In the art, such release or barrier layer is also applied with a transfer roller without the above-mentioned blade or roller knife technique. Without excluding this possibility of applying a layer in the present patent application, it is the inventors' experience that, generally, this does not yield a paper which has the desired properties to a sufficient extent. The structure of the layer on a paper where the layer has been applied with a transfer roller is usually considered to be too open. That is to say, the porosity of the layer and, accordingly, the paper is too high and the transfer efficiency is lower. However, by applying additional layers by techniques that provide a more closed layer, the too open structure of a layer applied with a transfer roller can be overcome.

The invention further relates to a method for printing transfer paper in which, when the paper is being printed with an inkjet printer with an aqueous dispersion of a sublimable ink, (substantially) no absorption of the dyes in the ink occurs or no non-uniform absorption of the dyes in the ink occurs.

The invention also relates to the use of transfer paper for printing with an inkjet printer, as well as to a method of printing a surface wherein, with an inkjet printer, a pattern is applied to a support material other than paper, for instance a plastic film suitable therefore, provided with a release or barrier layer, and wherein, by transfer printing, the pattern is subsequently transferred onto the surface (substrate) to be printed.

French patent specification 76022691 describes the composition of a water-based ink containing sublimable dyes, for printing transfer paper with an inkjet printer.

In accordance with a preferred embodiment of the present invention, a suitable layer to be applied to the paper is a hydrophilic polymer such as, for instance, polyvinyl alcohol, carboxymethylcellulose, alginate and gelatin or mixtures thereof, preferably carboxymethylcellulose. In a preferred embodiment of the present invention, carboxymethylcellulose having a degree of substitution (DS) of from about 0.2 to 0.3 is used.

In a preferred embodiment, the paper is provided with such a layer of carboxymethylcellulose that the layer has a porosity of at most 100 ml/min, more preferably at most 75 ml/min, and most preferably from 0 to 25 ml/min.

The release or barrier layer may also comprise fillers such as, for instance, kaolin, talcum and the like. This filler can be used in an amount of up to 15 wt. % as long as the properties of the layer are not adversely affected thereby. Also, to the release or barrier layer, or to the filler or the support paper, a non-transferable dye may be added, for instance as identification of the paper.

The layer can be applied in a manner known in the art, for instance with a coating provided with a wiping knife or roller knife. To obtain a sufficiently thick and dense layer, a number of layers may be applied one over the other. The thickness of the layer must be such that the layer is sufficiently dense and closed. For a layer that is sufficiently thick to obtain the desired porosity, a dry weight of between 1 and 10 $g/m^2$, preferably of 2–4 $g/m^2$, of the relevant layer is required, depending on the fillers-that are added to the layer, if any.

A closed layer is understood to mean that such an amount of coating has been applied that the number of openings that are usually visible on untreated paper surface under a scanning electron microscope with a magnification of about 60 times has been clearly reduced by the layer. Hence, the layer forms a virtually closed film on the paper. The size of the pores of the layer of the paper according to the invention is in the range of from 5 to 35 $\mu$m. The number of pores per unit area in the paper according to the invention is about 20 per $mm^2$, as against about 80 per $mm^2$ for the known types of transfer paper coated for anti-ghosting uses.

Without wishing to be limited thereby, the inventors assume that the thickness and composition of the layer provide for absorption of the water, while the properties of the layer and the small number of pores per unit area provide for an effect wherein the dispersed ink particles substantially remain on top of the layer and do not, or only to a highly limited extent, penetrate into the layer or into the pores of the layer. The release layer is of such composition that the water from the aqueous dispersion of sublimable dyes is taken up relatively fast, possibly through the underlying paper or any other layers between the base paper and the layer according to the invention, without the layer closing up, i.e. no longer taking up and/or passing water.

In a preferred embodiment, the release or barrier layer is generally applied to the wire side. The wire side of the paper is typically smoother than the felt side. Hence, it may be easier to obtain a sufficiently smooth and closed layer and, also, less material is required for obtaining that closed layer.

However, this does not alter the fact that the application of a sufficiently thick and smooth release or barrier layer to the felt side would not have the same effect. In principle, it holds that in a more closed layer, the transfer efficiency and the uniformity of the image improve.

As discussed hereinabove, an advantage of applying a barrier layer to the wire side of the paper is that the wire side of the paper is smoother. As a result, the applied release or barrier layer also has a more constant thickness. A more uniform layer of a constant thickness provides for a more even absorption or transport of the water from the ink, which adds to the quality of the transfer printing. Another advantage of applying the release or barrier layer to the wire side is that the irregularities that are normally present on the paper have a less great influence. When these irregularities are of a size such that the applied layer does not cover them, or only to a reduced extent, the porosity of the layer and, accordingly, the paper increases locally. As this takes place locally, the ink, during application, will in those places be taken up in the fibers of the paper. This non-uniform absorption does not only effect a reduction of the transfer efficiency, but also an irregular transfer of the sublimable dyes from the paper onto the surface, which is undesirable. In a preferred embodiment of the present invention, the release or barrier layer has a thickness that does not involve this non-uniform absorption.

The paper that is used in a preferred embodiment of the invention is of a composition such that during the application of the release or barrier layer and the printing with the aqueous ink, the paper retains a sufficient strength and dimensional stability, so that the paper will not cockle strongly or exhibit dimensional instability otherwise, at least not during printing. The paper has a weight of from 40 to 120 g/m$^2$, preferably of from 50 to 100 g/m$^2$, most preferably of from 60 to 80 g/m$^2$.

In the art, a paper is known that is used for printing images of photographic quality with an inkjet printer. This concerns paper which generally has a heavier quality (up to about 250 g/m$^2$) and, under normal conditions, can contain prints of photo quality. This paper is subject to extremely high requirements with regard to dimensional stability. Such paper must stand a loading degree of up to 300%, i.e. three colors are printed one over the other with a maximum color density/intensity. This paper is also known as photo-inkjet paper. When such photo-inkjet paper is provided with a release or barrier layer according to the invention, a high loading degree proves to be possible, while the dimensional stability of the paper is retained. This, too, does not involve any flowing of the sublimable dyes, while the transfer efficiency remains high.

Thus, in one embodiment, the invention also relates to a paper suitable for printing with an inkjet printer and built up from a single or multiple coated base, and which comprises a (top) layer according to the invention, preferably a carboxymethylcellulose layer.

In a further embodiment, the paper according to the invention is such that during printing of the paper by means of an inkjet printer with an aqueous ink containing a dispersion of sublimable dyes, substantially no flowing of the ink occurs.

In a method of manufacturing a transfer paper for inkjet printing, a release or barrier layer is applied to the base paper, preferably to the wire side thereof, while an excess of an aqueous solution of about 10–25 wt. % of carboxymethylcellulose as a viscous gel is applied first, by means of a coating process, and subsequently wiped with a wiping knife (blade knife) and dried in a usual manner.

When wiping techniques (such as a roller knife or wiping knife) are not sufficient for obtaining a sufficiently smooth and closed layer, it is possible to subject the paper with the layer already applied thereto to an additional treatment. In this additional treatment, an additional layer is applied to the paper in small dots by means of, for instance, rotary screen printing. These dots subsequently run one into another to form a film. In this manner, wiping stripes that may be caused during the application process with a wiping knife, can be masked and/or filled up as well.

In an elaboration of the method for printing transfer paper, an aqueous dispersion of sublimable dyes is applied to the paper by means of an inkjet printer, with the ink hardly flowing, if at all, after having been applied. This means that no strong mixing of the pixels occurs and an image is obtained that has a proper acutance and a proper color uniformity.

In an embodiment of the invention, a transfer paper is obtained which-after printing with an inkjet printer on the coated layer exhibits a considerable improvement of the transfer efficiency. On average, the paper with a layer according to the invention exhibits a significantly higher transfer efficiency of more than 80%, compared with conventional transfer paper printed by rotary screen printing, showing a transfer-efficiency of, on average, 65%.

The method can also be used for printing with an inkjet printer a support material other than paper, such as a plastic film suitable therefore, which material is provided with a release or barrier layer according to the invention, the inkjet printer applying an aqueous dispersion of sublimable dyes to the material, which dyes are transferred to a surface by transfer printing.

The surface onto which the image is eventually transferred may be, for instance, stone, wood, metal or another material, provided with a layer such as, for instance, a polyester layer. A condition for a suitable support material and a surface to be printed and the layer is that they be resistant to the temperatures that are common for transfer printing and retain their shape and dimension. For a sublimable ink, a transfer temperature ranging between about 170–210° C. applies, depending on the surface and the composition of the ink. This means that when the materials from which the support material and the surface are composed are film materials or other plastics, the processing temperature of these materials will have to be above the transfer temperature.

In the above embodiments, base materials other than conventional transfer paper are used for inkjet printing, such as an inkjet paper of photo quality, consisting of a single or multiple coated base or a film. These materials already have a low to very low porosity by themselves. To provide that the definition of the layer according to the invention also relates to this, the following is started from.

Of another base material, such as inkjet paper of photo quality, to which a layer according-to the invention has been applied, the transfer efficiency is determined. This transfer efficiency is compared with a transfer efficiency obtained with a base paper as described hereinabove, which is provided with a CMC layer according to the invention. When these transfer efficiencies correspond, it is assumed that the porosities of the two layers correspond as well.

In the appended Figures, the effect of the release or barrier layer is visible. All microscopic recordings have been taken with a scanning electron microscope with a magnification of 60 times:

FIG. 1: Uncoated transfer paper, viewed on the wire side.

Figure 2:
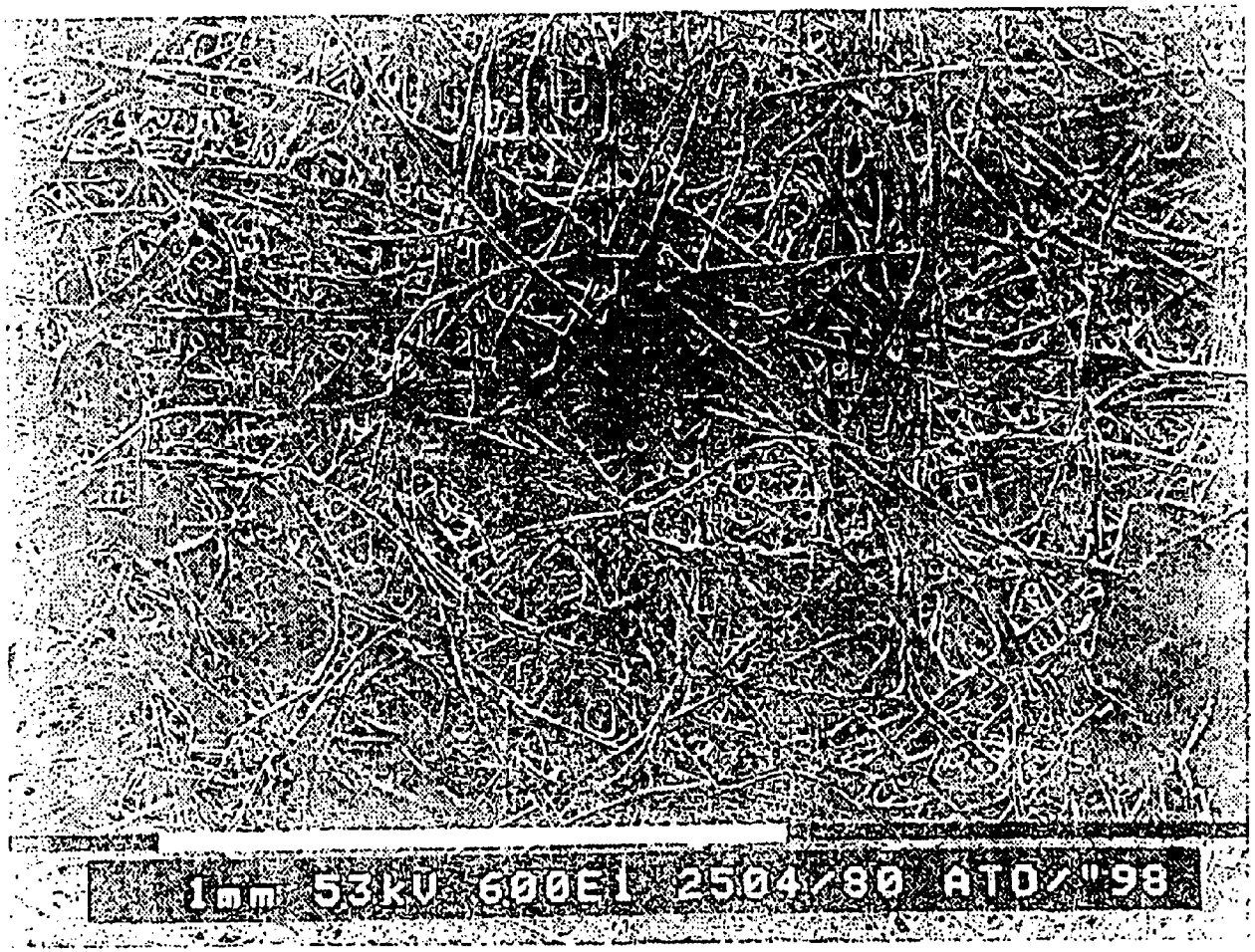

FIG. 2: transfer paper coated on the felt side (anti-ghosting paper).

Figure 3:
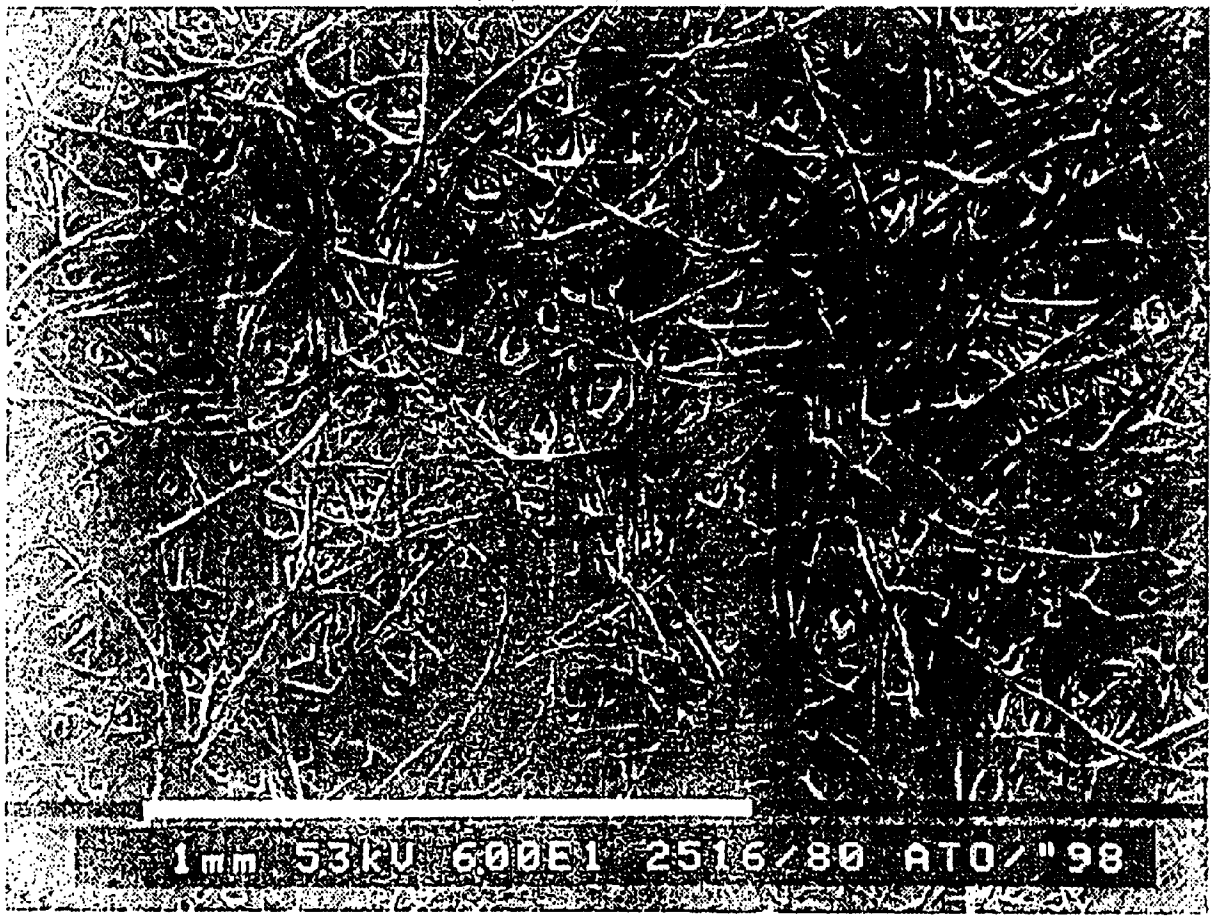

FIG. 3: transfer paper for inkjet printing, coated on the felt side.

The invention will now be specified on the basis of a number of examples.

| | | Examples: | | | | |
|---|---|---|---|---|---|---|
| | | Paper type 1 | | Paper type 2 | | |
| Weight | $g/m^2$ | 70 | 64 | 90 | 70 | 64 |
| Roughness (Bn) wire side | ml/min | 33 | 25 | 24 | 25 | |
| Roughness (Bn) felt side | ml/min | 140 | 200 | 220 | 220 | 240 |
| Porosity without release layer | ml/min | approx. 3000 | approx. 3000 | 950 | 1000 | 1300 |
| Porosity with release layer | ml/min | 0 | 1 | 4 | 5 | 7 |
| Coating yield | $g/m^2$ | approx. 2.2 | approx. 2.2 | | approx. 1.8 | |
| Transfer efficiency* | | ++ | ++ | – | + | ++ |
| Contrast* | | +++ | +++ | ++ | ++ | ++ |
| Uniformity* | | ++ | ++ | + | + | + |

*Visual assessment method by means of an internal panel, assessment range +++/++/+/±/–/––/–––.

What is claimed is:

1. A transfer paper suitable for inkjet printing, comprising:

(a) a base paper having a wire side and a felt side, and (b) a release or barrier layer at least on the side of said base paper to be printed, wherein the release or barrier layer:

is based on polyvinyl alcohol, carboxymethylcellulose, alginate, gelatin or mixtures thereof, has a porosity of at most 100 ml/min.

and contains filler in an amount up to 15 wt. %

2. A transfer paper according to claim 1, wherein the release or barrier layer is based on carboxymethylcellulose.

3. A transfer paper suitable for inkjet printing, comprising:

(a) a base paper having a wire side and a felt side, and (b) a release or barrier layer at least on the side of said base paper to be printed, wherein said release or barrier layer has a porosity of at most 100 ml/min. and contains filler, said filler being present in an amount up to 15 wt. % and wherein said filler is kaolin or talcum.

* * * * *

UNITED STATES PATENT AND TRADEMARK OFFICE

CERTIFICATE OF CORRECTION

PATENT NO. : 6,902,779 B1
APPLICATION NO. : 09/744637
DATED : June 7, 2005
INVENTOR(S) : Anthonie Cornelis de Visser et al.

It is certified that error appears in the above-identified patent and that said Letters Patent is hereby corrected as shown below:

Column 7, line 25, "+++/++/+/±/–/—/——." should read --+++/++/+/±/-/--/---.--

Signed and Sealed this

Twenty-first Day of November, 2006

JON W. DUDAS
*Director of the United States Patent and Trademark Office*